United States Patent [19]

Schwarzbauer

[11] 3,980,215

[45] Sept. 14, 1976

[54] TENNIS BALL HOLDER

[76] Inventor: Harvey Schwarzbauer, 1312 Whytecliff Road, Palatine, Ill. 60067

[22] Filed: Sept. 25, 1974

[21] Appl. No.: 509,226

[52] U.S. Cl. ..... 224/5 D; 206/315 B; 248/302; 211/49 R

[51] Int. Cl.[2] ..... A45C 11/00

[58] Field of Search ..... 224/5 D, 45 L, 5 R, 224/5 A, 26 R, 26 B, 29 B; 206/315; 294/19 A; 211/49 R, 49 S, 14, 181; 248/302; 24/3 D

[56] References Cited

UNITED STATES PATENTS

| | | | |
|---|---|---|---|
| 2,212,129 | 8/1940 | Rust | 211/49 R |
| 2,448,644 | 9/1948 | Williams | 294/19 A |
| 2,615,576 | 10/1952 | Dahlgren | 211/181 X |
| 2,757,698 | 8/1956 | Goodman | 224/5 D X |
| 2,768,775 | 10/1956 | Houser | 224/5 D |
| 3,602,370 | 8/1972 | Jerch et al. | 211/49 R |

*Primary Examiner*—Robert J. Spar
*Assistant Examiner*—Jerold M. Forsberg

[57] ABSTRACT

A tennis ball holder having a pair of generally parallel support arms which form a cage-like structure for containing two vertically stacked tennis balls. The support arms are coupled together at the top of the holder and have free ends at the bottom thereof to permit the holder to be spread apart for releasing a tennis ball when desired. The holder may be readily attached to the belt of the player to provide extra balls as required.

1 Claim, 4 Drawing Figures

TENNIS BALL HOLDER

BACKGROUND OF THE INVENTION

1. Description of the Prior Art

It is well known and is desirable for each tennis player to have two balls available when serving. Since the player has two serves, it is desirable not to interrupt the serving process to wait for ball retrieval and accordingly it is common for players to either hold a spare ball in their hand or place the ball in the pockets of their clothes, if possible. The present invention overcomes the need for either holding an extra ball or placing the ball in a player's pocket.

2. Field of the Invention

The field of art to which this invention pertains is ball holders and particularly to a holder for supporting two vertically stacked tennis balls where the holder is portable and designed to be carried by a player by attachment to his tennis apparel.

SUMMARY OF THE INVENTION

It is an important feature of the present invention to provide a means for supporting a number of tennis balls while a player is in action.

It is a further feature of the present invention to provide an improved tennis ball holder for being worn by a tennis player.

It is a principal object of the present invention to provide a tennis ball holder for supporting a pair of vertically stacked tennis balls.

It is also an object of the present invention to provide a tennis ball holder for supporting a pair of vertically stacked tennis balls wherein the holder has support arms for gripping the balls and has inherent resiliency for permitting one or more of the balls to be released as desired.

It is a further object of the present invention to provide a tennis ball holder as described above wherein the support arms are connected together at one end and have the opposite ends unconnected or free to be spread apart for releasing a ball contained therein.

It is also an object of the present invention to provide a tennis ball holder of the type described above wherein the support arms are formed of wire with each arm having two vertical wire supports and the combination of said arms forming a wire cage for containing two vertically stacked tennis balls.

It is yet another object of the present invention to provide a tennis ball holder having a pair of support arms for gripping two vertically stacked tennis balls wherein the support arms are made of a resilient material and are attached together at at least one point and wherein the arms may be spread apart at at least one point to release a ball therefrom.

It is still another object of the present invention to provide a tennis ball holder of the type described above wherein the support arms have seat portions at the free ends thereof and wherein the upper of the vertically stacked balls is permitted to slide freely to the position of the seat portions after removal of the lower ball.

These and other objects, features and advantages of the present invention will be understood in greater detail from the following description and the associated drawing wherein reference numerals are utilized to designate a preferred embodiment.

DESCRIPTION OF THE PREFERRED EMBODIMENT

The present invention relates to a tennis ball holder and in particular to a holder for being attached to the apparel of a tennis player to support a pair of vertically stacked tennis balls and to releasably position the balls in such a way that the removal of one of the balls automatically places the second ball in position for easy access.

It is well known that tennis players desire to have a pair of balls available especially during serve, and accordingly, the present invention provides a means for easily supporting the balls on the apparel of the tennis player and avoiding the necessity for the player to either hold the next ball in his hand or place an extra ball in his pocket if one is available.

The tennis ball holder of the present invention, in the preferred embodiment, is formed of wire and consists of a pair of support arms which contain the ball in a cage-like structure. The balls are vertically stacked and rest on a pair of seat portions of the holder. The seat portions are formed on free ends of the support arms and may be spread apart as desired due to the inherent resiliency of the wire structure to permit the lower of the two balls to be readily removed and the upper ball to descend to the lower position. The structure itself may be formed of other materials such as plastic or any material having inherent resiliency to perform the functions described.

Figure 1:
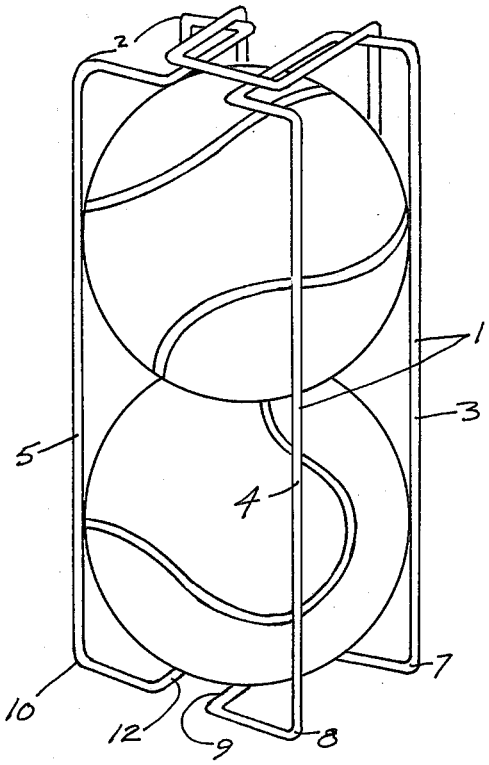
FIG. 1 is a perspective of a tennis ball holder according to the present invention showing a pair of vertically stacked tennis balls contained therein.

Referring to the drawings in greater detail, FIG. 1 shows a tennis ball holder of the present invention in perspective with a pair of tennis balls stacked vertically therein. The holder consists of a support arm 1 and a further support arm 2. The support arm 1 consists of two vertical wire supports 3 and 4 while the support arm 2 consists of a further pair of vertical wire supports 5 and 6.

Figure 2:
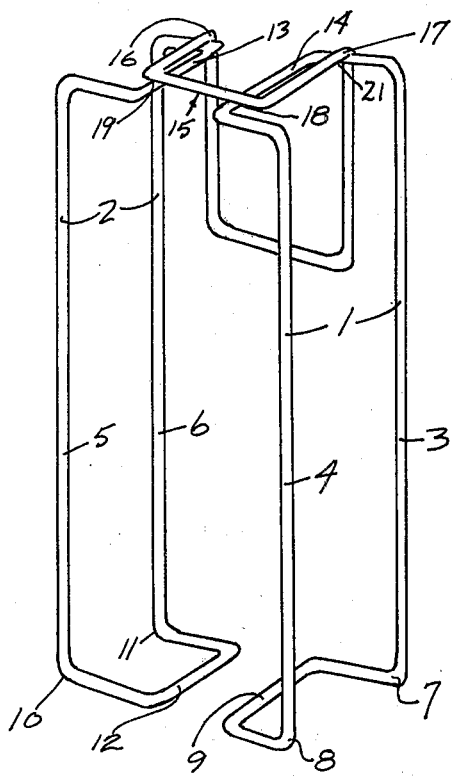
FIG. 2 is a perspective of a tennis ball holder of FIG. 1 with the balls removed and showing the internal structure thereof as well as the means for supporting the holder on the belt of a tennis player.

As shown more clearly in FIG. 2, the vertical wire supports 3 and 4 are bent at right angles at points 7 and 8 to form a seat portion 9. In a similar manner the wire supports 5 and 6 are bent at points 10 and 11 to form a seat portion 12. The seat portion 9 and 12 together provide a resting position for the balls as shown in FIG. 1.

As shown, the ends of the wire supports which terminate in the seat portions 9 and 12 are free ends while the opposite upper ends which are bent similarly to form top portions 13 and 14 are rigidly fastened together by means of a bracket 15.

Figure 4:
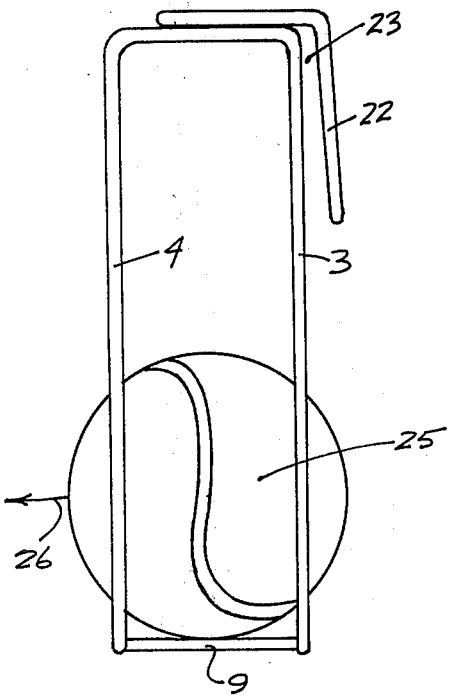
FIG. 4 is a side view of the tennis ball holder shown in FIGS. 1 and 2 with the lower ball removed and the upper ball having been automatically permitted to slip to the position of the lower ball against the seat portions of the free ends of the support arms of the holder.

The bracket 15 consists of a rectangular piece of wire which is bent at points 16 and 17 and which may be welded at points 18, 19, 20 and 21, for example, to rigidly couple the support arms 1 and 2 together at the upper portion of the tennis ball holder. The vertical portion of the bracket 15, as shown at 22 in FIG. 4, is spaced rearwardly from the wire supports 3 and 6 as shown at 23 to permit the tennis ball holder to be hooked on the belt of a player. The belt may simply be inserted in the space 23 between the wire supports 3 and 6 at the rear of the holder and the generally vertical portion 22 of the bracket 15.

Figure 3:
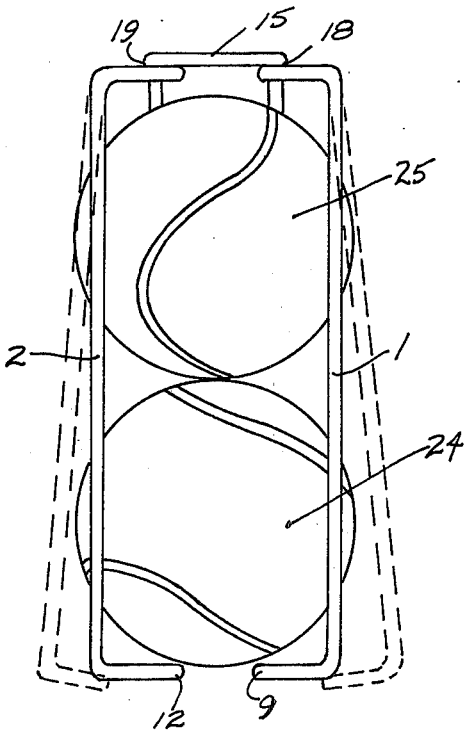
FIG. 3 is a front view of the tennis ball holder of FIG. 1 showing the support arms in their normal relaxed position and also showing in dashed lines the support arms in their spread or flexed position to permit the release of the lower tennis ball therefrom.

The operation of the tennis ball holder of the invention is shown in FIG. 3. When it is desired to release a ball from the holder, the player grasps the lower ball, identified as 24, and simply forceably pulls the ball toward the front of the holder. The curved portions of the ball spread the support arms 1 and 2 to the position shown by the dashed lines in FIG. 3. In this position, it can be seen that the ball 24 has a diameter which is less than the distance between the spread arms 1 and 2 and can readily be removed.

When the ball 24 is removed, the upper ball 25 merely slips downwardly to the position previously occupied by the ball 24 and then may be readily removed as needed by the same process. In a like manner, the balls may be readily re-inserted simply by pressing against the support arms 1 and 2 with the curvilinear surface of the ball causing the arms to spread apart to the position shown by the dashed lines in FIG. 3.

FIG. 4 shows the case where the ball 24 has been removed and the ball 25 has then dropped to the lower position were it may be readily removed by a forced outward motion on the ball in the direction shown by the arrow 26.

Accordingly, the present invention provides a means for a tennis player to have a pair of tennis balls at his disposal without the inconvenience and inaccessibility of having the balls in the pocket of his clothing or holding an extra ball in his hand.

I claim:

1. A portable tennis ball holder formed of wire, comprising:

a top wire bracket, a pair of flexible wire gripper members facing each other and each having a top end bent inwardly and rigidly affixed to said top wire bracket at opposite sides thereof to be supported thereby and having free ends at the bottom edge, each of said free ends being bent inwardly to form a seat at the lower extremity for retaining a tennis ball between said pair of flexible wire gripper members, said gripper members facing each other in parallel relation and being spaced apart by a distance which is less than the diameter of a tennis ball to be held therebetween, each of said gripper members including a pair of parallel longitudinal segments spaced apart by a distance which is less than the diameter of the ball thereby allowing a portion of the ball to protrude therethrough, the edges of said gripper members defining a pair of substantially equal sized rectangular end openings at opposite ends of the holder to permit a pair of tennis balls to be inserted and removed therefrom, said gripper members having sufficient resiliency to permit tennis balls to be readily inserted and removed through said end openings, and said top wire bracket having a portion extending parallel to said flexible gripper members for receiving the belt of a player therebetween, whereby said flexible gripper members retain vertically stacked tennis balls and said free ends permit the ready removal of the lower stacked ball allowing the upper stacked ball to drop freely to the lower position at said seat.

* * * * *